US010650676B2

(12) United States Patent
Bhat et al.

(10) Patent No.: US 10,650,676 B2
(45) **Date of Patent: *May 12, 2020**

(54) USING AUTOMOBILE DRIVER ATTENTION FOCUS AREA TO SHARE TRAFFIC INTERSECTION STATUS

(71) Applicant: INTERNATIONAL BUSINESS MACHINES CORPORATION, Armonk, NY (US)

(72) Inventors: Gautam K. Bhat, Kardri (IN); Gregory J. Boss, Saginaw, MI (US); Kevin C. McConnell, Austin, TX (US); Minh Q. Pham, Austin, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/357,708

(22) Filed: Mar. 19, 2019

(65) Prior Publication Data

US 2019/0213880 A1 Jul. 11, 2019

Related U.S. Application Data

(63) Continuation of application No. 15/715,602, filed on Sep. 26, 2017, now Pat. No. 10,282,986, which is a (Continued)

(51) Int. Cl.
*G08G 1/09* (2006.01)
*G08G 1/0962* (2006.01)

(52) U.S. Cl.
CPC ..... *G08G 1/09623* (2013.01)

(58) Field of Classification Search
CPC ..... G08G 1/09623
See application file for complete search history.

(56) References Cited

U.S. PATENT DOCUMENTS 6,747,574 B2 6/2004 Butzer et al.
7,692,552 B2 4/2010 Harrington et al.
(Continued)

FOREIGN PATENT DOCUMENTS

WO 2010115020 A2 10/2010
WO 2013016230 A1 1/2013

OTHER PUBLICATIONS

Guan, Adrian, Sharing Traffic Signal Timing with Vehicles: A Non-DSRC Survey, ITS America; Accessed Aug. 7, 2015, 10 pages.
(Continued)

*Primary Examiner* — Phung Nguyen
(74) *Attorney, Agent, or Firm* — Brian Restauro; Andrew D. Wright; Roberts Calderon Safran & Cole, P.C.

(57) ABSTRACT

Systems and methods for alerting a driver to a status of a traffic signal are disclosed. A computer-implemented method includes: detecting, by a computing device, that a vehicle is stopped at an intersection with a traffic signal; determining, by the computing device, an attention focus area of a driver of the vehicle; determining, by the computing device, a target display device based on the determined attention focus area; and causing, by the computing device, the determined target display device to display information to alert the driver of a status of the traffic signal.

20 Claims, 6 Drawing Sheets

Related U.S. Application Data continuation of application No. 14/927,563, filed on Oct. 30, 2015, now Pat. No. 9,824,581.

(56) References Cited

U.S. PATENT DOCUMENTS

| | | | | |
|---|---|---|---|---|
| 8,031,062 | B2 | 10/2011 | Smith | |
| 9,092,986 | B2 | 7/2015 | Salomonsson et al. | |
| 9,824,581 | B2 | 11/2017 | Bhat et al. | |
| 2009/0174573 | A1 | 7/2009 | Smith | |
| 2010/0253541 | A1 | 10/2010 | Seder et al. | |
| 2011/0077028 | A1 | 3/2011 | Wilkes, III et al. | |
| 2012/0319867 | A1 | 12/2012 | Gordon | |
| 2013/0018705 | A1 | 1/2013 | Heath et al. | |
| 2013/0063281 | A1 | 3/2013 | Malaska | |
| 2013/0166109 | A1* | 6/2013 | Ginsberg | G08G 1/0967 701/2 |
| 2015/0077271 | A1 | 3/2015 | Alshinnawi et al. | |
| 2015/0149020 | A1 | 5/2015 | Smith | |
| 2015/0262483 | A1 | 9/2015 | Sugawara | |
| 2016/0314689 | A1* | 10/2016 | Priest, III | B60W 50/14 |
| 2017/0316273 | A1* | 11/2017 | Ferguson | G06K 9/00825 |
| 2018/0018873 | A1 | 1/2018 | Bhat et al. | |

OTHER PUBLICATIONS

Anonymous, "Traffic Congestion—Ingienous Designs," http://ingienous.com/2012/04/19/traffic-congestion/; Accessed Aug. 12, 2015, 3 pages.

Anonymous, "IBM Global Commuter Pain Survey: Traffic Congestion Down, Pain Way Up", http://www-03.ibm.com/press/us/en/pressrelease/35359.wss, IBM News Room, Sep. 8, 2011; 4 pages.

* cited by examiner

USING AUTOMOBILE DRIVER ATTENTION FOCUS AREA TO SHARE TRAFFIC INTERSECTION STATUS

BACKGROUND

The present invention relates generally to managing automobile traffic flow and, more particularly, to methods and systems for alerting a driver stopped at a traffic signal when the light changes.

In many places it is prohibited to use a smartphone while driving an automobile. However, in some places it is permissible for a driver to use a smartphone while the driver's automobile is stopped at a traffic signal (e.g., stop light). When a driver is stopped at a red light and their attention is focused on their smartphone (e.g., texting, checking email, selecting music, etc.), the driver often does not notice when the traffic signal changes from a red light to a green light. Such actions by drivers increase delay in automobile traffic flow and aggravate other drivers. This has significant impact on others, since between 60% and 80% of respondents in studies indicate that traffic is a key inhibitor to work and/or school performance.

When a driver is distracted by their mobile device while stopped at a red light, it often comes down to other drivers honking their horn to alert the driver that the light has changed from red to green. However, in many countries, honking your automobile horn at another driver is considered rude or impolite. Moreover, excessive honking of automobile horns also contributes to increased noise pollution.

SUMMARY

In an aspect of the invention, there is a computer-implemented method for alerting a driver to a status of a traffic signal. The method includes: detecting, by a computing device, that a vehicle is stopped at an intersection with a traffic signal; determining, by the computing device, an attention focus area of a driver of the vehicle; determining, by the computing device, a target display device based on the determined attention focus area; and causing, by the computing device, the determined target display device to display information to alert the driver of a status of the traffic signal.

In another aspect of the invention, there is a computer program product for alerting a driver to a status of a traffic signal. The computer program product includes a computer readable storage medium having program instructions embodied therewith. The program instructions are executable by a computing device to cause the computing device to: detect that a vehicle is stopped at an intersection with a traffic signal; determine an attention focus area of a driver of the vehicle by analyzing at least one of direct indicators and indirect indicators; determine a target display device based on the determined attention focus area; cause the determined target display device to display information to alert the driver of a status of the traffic signal; and cause the determined target display device to change the displayed information based on a changed status of the traffic signal.

In another aspect of the invention, there is a system for alerting a driver to a status of a traffic signal. The system includes a CPU, a computer readable memory and a computer readable storage medium associated with a computing device. The system includes: program instructions to detect that a vehicle is stopped at an intersection with a traffic signal; program instructions to determine an attention focus area of a driver of the vehicle by analyzing at least one of direct indicators and indirect indicators; program instructions to determine a target display device based on the determined attention focus area; program instructions to cause the determined target display device to display information to alert the driver of a status of the traffic signal; and program instructions to cause the determined target display device to change the displayed information based on a changed status of the traffic signal. The program instructions are stored on the computer readable storage medium for execution by the CPU via the computer readable memory. The target display device is one of: a mobile device, and a fixed electronic display that is part of the vehicle. The displayed information includes one of: a background color the same as a color of a light illuminated at the traffic signal; an icon showing the color of the light illuminated at the traffic signal; arrows indicating direction status of the traffic signal; and a timer indicating a countdown time until the traffic signal changes.

BRIEF DESCRIPTION OF THE DRAWINGS

The present invention is described in the detailed description which follows, in reference to the noted plurality of drawings by way of non-limiting examples of exemplary embodiments of the present invention.

DETAILED DESCRIPTION

Figure 1:
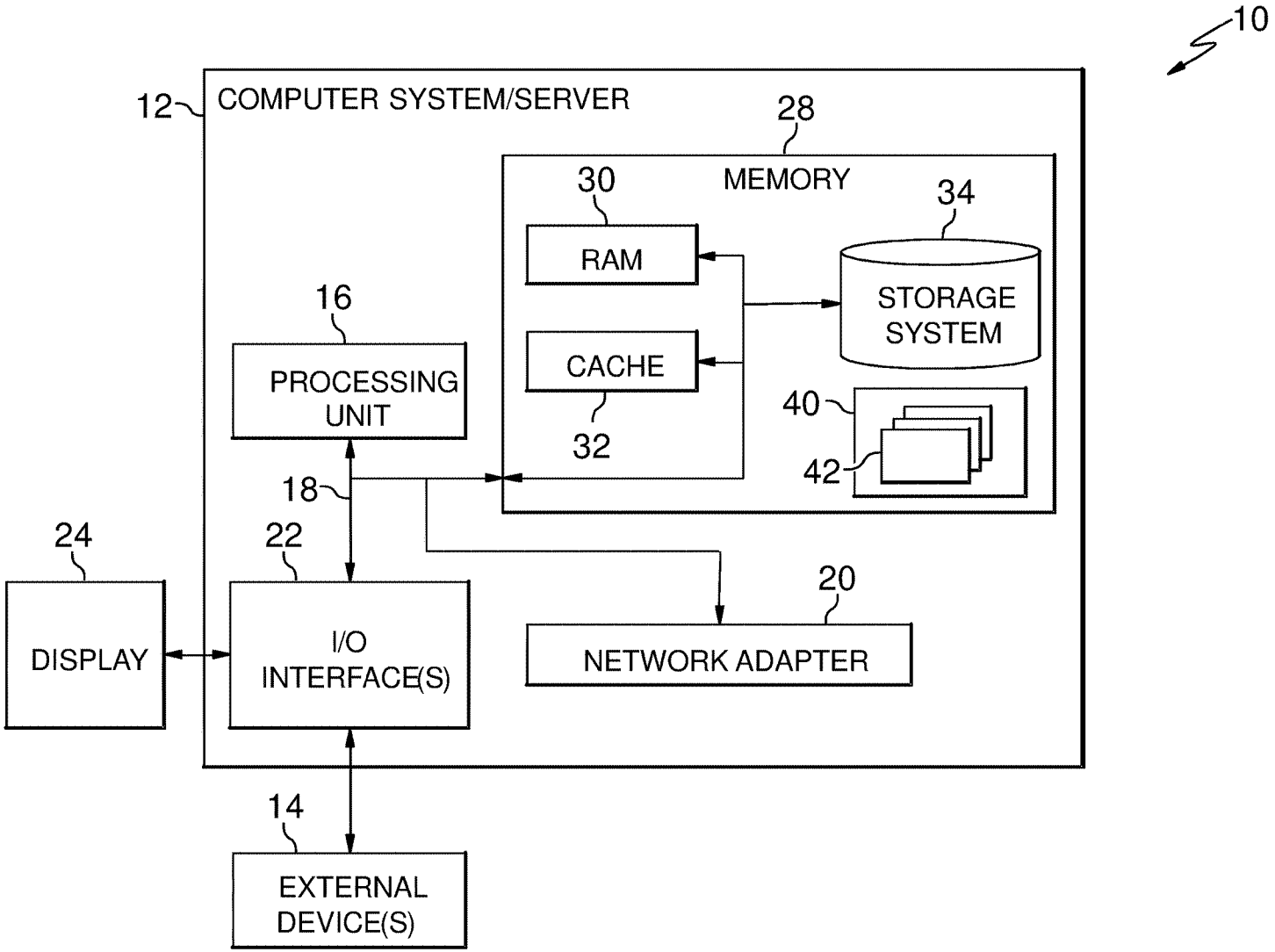
FIG. 1 depicts a computing infrastructure according to an embodiment of the present invention.

The present invention relates generally to managing automobile traffic flow and, more particularly, to methods and systems for alerting a driver stopped at a traffic signal when the light changes. According to aspects of the invention, a driver's cognitive attention focus area is determined when the driver's automobile is stopped at a traffic signal, and a visual display of an electronic device in the determined attention focus area is modified to alert the driver that the traffic signal has changed state (e.g., from a red light to a green light). For example, when it is determined that the driver is focused on their smartphone while stopped at a traffic signal, the display of the smartphone is modified to alert the driver to a changing state of the traffic signal. In this manner, implementations of the invention assist a driver in knowing that the traffic signal has changed (e.g., from a red light to a green light) when the driver's attention is diverted to an electronic device.

An aspect of a system includes an intelligent traffic signal system that can communicate its status using short range wireless technologies to other computing devices. Another aspect includes a mobile device application that is integrated with the mobile device's global positioning system (GPS) radio, short range wireless radios, and accelerometers. Using GPS technology, the application runs in the background to monitor the location of the mobile device. When the application detects that an automobile carrying the mobile device has stopped at an intersection, the application begins to receive traffic signal status from the intelligent traffic signal system.

Another aspect includes determining where the driver's attention lies by processing direct and indirect indicators of the driver's cognitive attention focus area. The application then uses one of the following methods to modify an electronic display in the determined cognitive attention focus area to alert the driver of the status of the traffic signal: traffic light color appearing in the background of the electronic display; traffic light color appearing as an icon at a corner of the electronic display; intersection map shown in the electronic display showing traffic light status in all directions of the intersection; count-down counter to when the traffic signal will change shown in the electronic display; generate an audible sound indicating the traffic signal is about to change; blackout the screen of the electronic display prior to the traffic signal changing state.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowcharts and block diagrams in the Figures illustrate the architecture, functionality, and operation of possible implementations of systems, methods, and computer program products according to various embodiments of the present invention. In this regard, each block in the flowcharts may represent a module, segment, or portion of instructions, which comprises one or more executable instructions for implementing the specified logical function (s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the flowchart illustrations, and combinations of blocks in the flowchart illustrations, can be implemented by special purpose hardware-based systems that perform the specified functions or acts or carry out combinations of special purpose hardware and computer instructions.

Referring now to FIG. 1, a schematic of an example of a computing infrastructure is shown. Computing infrastructure 10 is only one example of a suitable computing infrastructure and is not intended to suggest any limitation as to the scope of use or functionality of embodiments of the invention described herein. Regardless, computing infrastructure 10 is capable of being implemented and/or performing any of the functionality set forth hereinabove.

In computing infrastructure 10 there is a computer system 12, which is operational with numerous other general purpose or special purpose computing device environments or configurations. Examples of well-known computing devices, environments, and/or configurations that may be suitable for use with computer system 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system 12 may be described in the general context of computer system executable instructions, such as program modules, being executed by a computer system. Generally, program modules may include routines, programs, objects, components, logic, data structures, and so on that perform particular tasks or implement particular abstract data types. Computer system 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system 12 in computing infrastructure 10 is shown in the form of a general-purpose computing device. The components of computer system 12 may include, but are not limited to, one or more processors or processing units (e.g., CPU) 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system 12 typically includes a variety of computer system readable media. Such media may be any available media that is accessible by computer system 12, and it includes both volatile and non-volatile media, removable and non-removable media.

System memory 28 can include computer system readable media in the form of volatile memory, such as random access memory (RAM) 30 and/or cache memory 32. Computer system 12 may further include other removable/non-removable, volatile/non-volatile computer system storage media. By way of example only, storage system 34 can be provided for reading from and writing to a nonremovable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system 12 may also communicate with one or more external devices 14 such as a keyboard, a pointing device, a display 24, etc.; one or more devices that enable a user to interact with computer system 12; and/or any devices (e.g., network card, modem, etc.) that enable computer system 12 to communicate with one or more other computing devices. Such communication can occur via Input/Output (I/O) interfaces 22. Still yet, computer system 12 can communicate with one or more networks such as a local area network (LAN), a general wide area network (WAN), and/or a public network (e.g., the Internet) via network adapter 20. As depicted, network adapter 20 communicates with the other components of computer system 12 via bus 18. It should be understood that although not shown, other hardware and/or software components could be used in conjunction with computer system 12. Examples, include, but are not limited to: microcode, device drivers, redundant processing units, external disk drive arrays, RAID systems, tape drives, and data archival storage systems, etc.

Figure 2:
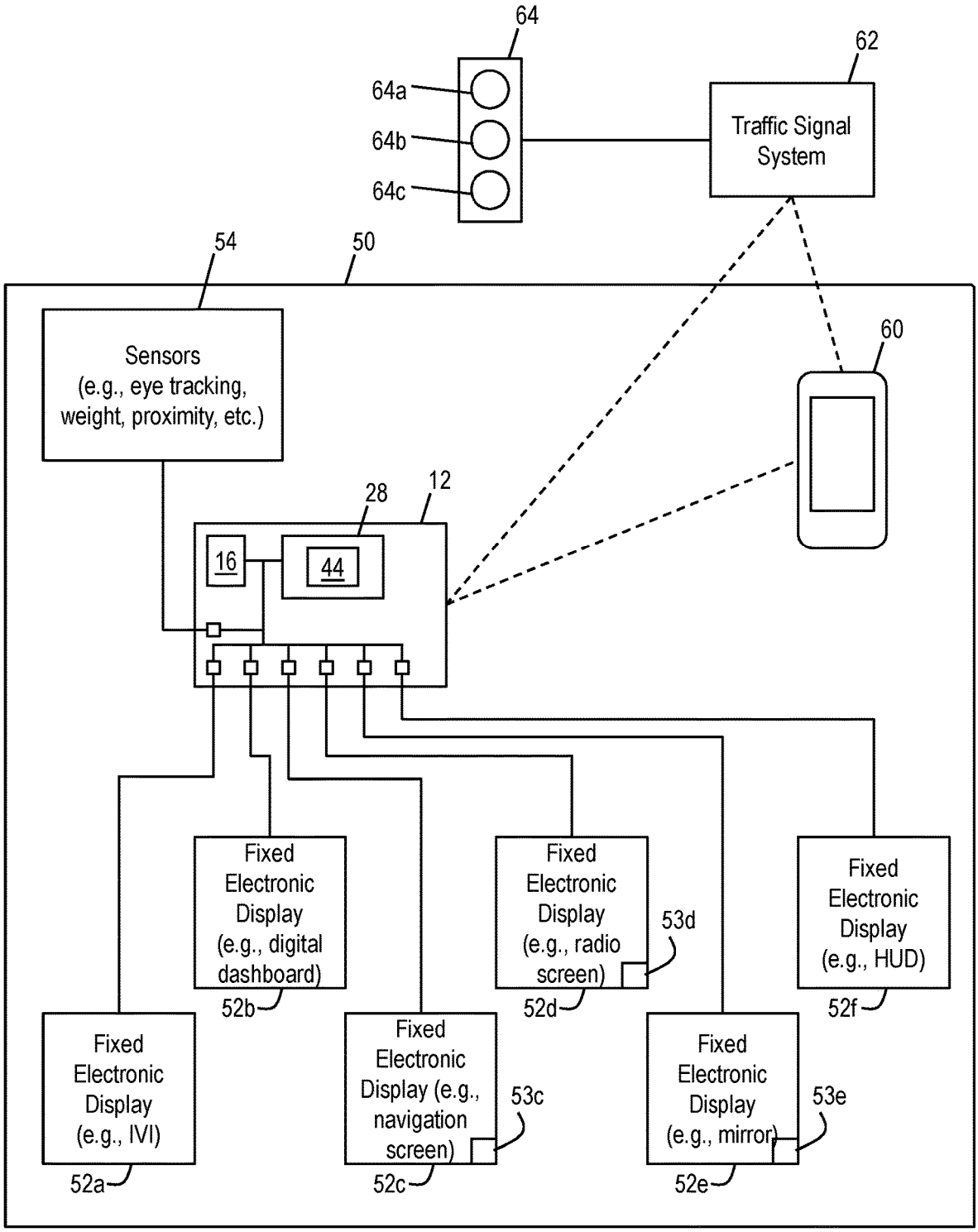
FIG. 2 shows an exemplary environment in accordance with aspects of the invention.

FIG. 2 shows an exemplary environment in accordance with aspects of the invention. The environment includes a vehicle 50 (e.g., an automobile) comprising the computer system 12 of FIG. 1 and a number of fixed electronic displays 52*a-f*. The computer system 12 may include a processor 16, memory 28, and program modules 44, in addition to other elements described with respect to FIG. 1. The computer system 12 may include a Global Positioning System (GPS) that determines a GPS location of the vehicle 50. As used herein, a fixed electronic display is an electronic display device that is permanently affixed to the vehicle 50. Examples of fixed electronic displays include an in-vehicle-infotainment (IVI) system 52*a*, a digital dashboard 52*b*, a navigation screen 52*c*, a radio screen 52*d*, a digital mirror 52*e*, and a head's-up-display (HUD) 52*f*. Implementations of the invention are not limited to this number of fixed electronic displays and these types of fixed electronic displays, and instead any number of any suitable type of fixed electronic displays may be used in implementations.

One of more of the fixed electronic displays 52*a-f* may include or be connected to a user input device, such as a touch screen, button, knob, or lever. For example, the navigation screen 52*c* may include a touch screen 53*c* by which a user may provide input to a navigation system associated with the navigation screen 52*c*. As another example, the vehicle 50 may include at least one of a physical button and knob 53*d* adjacent the radio screen 52*d* by which a user may provide input to a radio system associated with the radio screen 52*d*. As another example, the vehicle 50 may include at least one of a physical button, knob, and lever 53*e* by which a user may provide input to adjust a position of the digital mirror 52*e*.

As shown in FIG. 2, each of the fixed electronic displays 52*a-f* is connected to the computer system 12. In this manner, the computer system 12 can provide signals that cause a desired graphic output to be displayed on each respective one of the fixed electronic displays 52*a-f*. For example, one of the program modules 44 may provide signals that define the content that is visually displayed on the (IVI) system 52*a*. Similarly, other respective program modules 44 may provide signals to the digital dashboard 52*b*, navigation screen 52*c*, radio screen 52*d*, digital mirror 52*e*, and head's-up-display (HUD) 52*f* that define the respective content that is visually displayed on the respective displays.

Still referring to FIG. 2, the computer system 12 may be provided with a spatial location of each of the fixed electronic displays 52*a-f* within the vehicle. For example, the memory 28 may store pre-defined data that indicates coordinates (e.g., x-y-z coordinates) of each of the fixed electronic displays 52*a-f* in a coordinate system relative to the vehicle 50.

As further illustrated in FIG. 2, the vehicle 50 may include one or more sensors 54 connected to the computer system 12. In embodiments, the sensors 54 provide data that is used by the computer system 12 to determine a focus of a driver (e.g., human operator) of the vehicle 50.

The sensors 54 may include an eye tracking system in the vehicle 50 that detects a gaze location of the driver. In embodiments, one of the program modules 44 may be configured to compare the data from the eye tracking system to the stored coordinates of each of the fixed electronic displays 52*a-f* to determine that the driver is looking at a particular one of the fixed electronic displays 52*a-f*.

The sensors 54 may include at least one weight sensor in a driver seat of the vehicle 50 that detects weight distribution of the driver in the driver seat. In embodiments, one of the program modules 44 may be configured to compare the data from the at least one weight sensor to predefined data stored in memory 28 to determine whether the driver is in a facing-forward seating position or a non-facing-forward seating position. For example, the predefined data may indicate that certain detected weight distributions of the driver in the driver seat are equated with a facing-forward seating position, and that other detected weight distributions of the driver in the driver seat are equated with a non-facing-forward seating position (e.g., leaning into the back seat area of the vehicle).

The sensors 54 may also include one or more of: a sensor (e.g., pressure sensor) that detects whether the driver's hands are gripping the steering wheel; a sensor (e.g., camera) that detects an observed location and position of the driver's body, head, and/or hands; seat proximity systems; and sensors that detect a reflection of the driver in a mirror 52*e*.

Still referring to FIG. 2, the environment may include at least one temporary display device 60 within the vehicle 50. As used herein, a temporary display device 60 is an electronic display device that is not permanently affixed to the vehicle 50. Examples of temporary display devices include a smartphone, tablet computer, smart watch, and digital eye glasses, although aspects of the invention are not limited to these types and other suitable types of temporary display device may be used in implementations.

In a preferred embodiment, the temporary display device 60 is a smartphone comprising at least a processor, memory, display, input device (e.g., touch screen and/or physical buttons), accelerometer, GPS, and antenna for wireless communication. The temporary display device 60 and computer system 12 are configured to communicate with one another via wireless communication (e.g., Bluetooth, WiFi, near field communication) and/or wired communication (e.g., Universal Serial Bus (USB) cable). The temporary display device 60 may register with the computer system 12, e.g., by pairing. In embodiments, the computer system 12 requests that a registered temporary display device 60 report its location, or automatically determine the location of the registered temporary display device 60 via triangulation and/or proximity.

In embodiments, the computer system 12 communicates with the temporary display device 60 and queries the temporary display device 60 for the following types of activity: screen is turned on (e.g., active); keystrokes that indicate user action; messages (e.g., SMS messages) sent or received or viewed; applications launched; user interaction with applications; telephone call in progress, and whether the call is via hand held, Bluetooth headset, connected through the vehicle; and movement detected by the accelerometer. The computer system 12 may also communicate with the temporary display device 60 to visually display desired content on the display of the temporary display device 60.

Still referring to FIG. 2, the environment includes a traffic signal system 62 and a traffic signal 64. In embodiments the traffic signal system 62 is a computing device that controls the traffic signal 64 and that wirelessly broadcasts a status signal that can be received by the computer system 12 and/or temporary display device 60. The traffic signal system 62 controls the traffic signal 64, for example, by transmitting control signals to the traffic signal 64 that cause the traffic signal 64 to turn on/off a first (e.g., red) light 64*a*, second (e.g., yellow) light 64*b*, and third (e.g., green) light 64*c*. The control of the traffic signal 64 may be performed in a conventional manner, such as based on timing and/or traffic sensors that detect vehicles at an intersection where the traffic signal 64 is installed.

According to aspects of the invention, the traffic signal system 62 uses short range wireless communication to broadcast as status signal, which includes data that defines a status of the traffic signal 64 and an identifier of the traffic signal 64. The data that defines the status of the traffic signal 64 may include, for example, data that indicates a light (e.g., one or more of 64*a-c*) that is currently illuminated (e.g., on), a next light to be illuminated, and how much time remains until the next light becomes illuminated. The data that defines an identifier of the traffic signal 64 may include, for example, GPS coordinates of the traffic signal 64 and/or a unique alpha-numeric identifier of the traffic signal 64.

In embodiments, the traffic signal system 62 continuously broadcasts the status signal, e.g., once every second or fraction of a second. An application (e.g., program module) running on the computer system 12 or temporary display device 60 detects the status signal when the vehicle 50 carrying the temporary display device 60 drives within range of the broadcast status signal. An application running on the computer system 12 or temporary display device 60 is also configured to detect when the vehicle 50 stops at an intersection associated with the traffic signal 64 (e.g., by comparing unchanging GPS location of the vehicle 50 to broadcast GPS location of the traffic signal 64).

According to aspects of the invention, based on detecting that the vehicle 50 is stopped at an intersection associated with the traffic signal 64, the system determines the driver's cognitive "attention focus area" and then controls an electronic display device in the determined attention focus area to display information that indicates a status of the traffic signal 64. In embodiments, the system determines the driver's attention focus area based on direct indicators and/or indirect indicators.

In aspects, direct indicators include analyzing where the driver's eye's are focusing (e.g., gaze location), which may be determined using the eye tracking system included in the sensors 54, for example. The system may also determine the time the driver spends looking at a particular focus area/gaze location. The time a person's visual focus is on a single object is indicative of the cognitive attention focus area. For example, a driver looking at a radio screen for ten seconds is a greater direct indicator than looking at the radio screen for one second. Other direct indicators include analyzing where the driver's hands are located and what they are doing, which also may be determined using sensors 54.

In embodiments, indirect indicators include detectable conditions or actions which have a strong correlation to a driver's attention focus area. Indirect indicators may include detecting that the driver is using an input device of one or more of: the fixed electronic displays 52*a-f*, and the temporary display device 60. Indirect indicators may include, for example, detection that a user is providing input to a fixed electronic displays 52*a-f*, e.g., via input devices 53*c*, 53*d*, 53*e*, etc. Indirect indicators may include, for example, detection that a user is providing input to the temporary display device 60, e.g., via input devices such as buttons and/or touch screen associated with the temporary display device 60. Indirect indicators may include, for example, inferring that a user is utilizing the temporary display device 60 by detecting at least one of: the screen is turned on (e.g., active); keystrokes that indicate user action; messages (e.g., SMS messages) sent or received or viewed; applications launched; user interaction with applications; telephone call in progress; and movement of the accelerometer. For example, the temporary display device 60 may detect via its accelerometer that the device is being moved around, and may also detect that a map application is open and that an input is being provided (e.g., via touch screen) to pan or zoom the display of the map of the map application. These detected indirect indicators can be used to infer that the driver's attention is focused on the temporary display device 60.

The computer system 12 of the vehicle 50 may detect indirect indicators associated with the fixed electronic displays 52*a-f* (e.g., using an input device of the radio screen 52*d*). The temporary display device 60 may detect indirect indicators associated with itself (e.g., input to the touchscreen) and communicate this data to the computer system 12 of the vehicle 50. In this manner, one of the program modules 44 of the computer system 12 may be used to analyze the indirect indicators of both the fixed electronic displays 52*a-f* and the temporary display device 60.

In accordance with aspects of the invention, the system analyzes one or more of the direct indicators and the indirect indicators to determine the driver's attention focus area. The system may determine a target display device based on the determined attention focus area. The target display device may be one of the fixed electronic displays 52*a-f* or one of the temporary display devices 60. For example, the system may determine the driver's attention focus area by the sensors 54 detecting that the driver's eyes are focused on a particular location in the vehicle 50 for an amount of time greater than the threshold time. The system may determine that this determined attention focus area corresponds to the radio screen 52*d*, e.g., by comparing the coordinates of the location of the determined attention focus area (e.g., from the eye tracking system) to the coordinates of the radio screen 52*d* as stored in the system memory. In this manner, the system may utilize direct indicators (e.g., data from sensors 54) to determine that the radio screen 52*d* as the target display device on which to display a traffic signal status indicator.

In another example, the system may determine the driver's attention focus area by the temporary display device 60 indicating to the computer system 12 that the user is providing input to the temporary display device 60. For example, the temporary display device 60 may communicate to the computer system 12 that the temporary display device 60 is powered on and the I/O system is being utilized (e.g., keys are being pressed) to send text messages. In this manner, the system may utilize indirect indicators to determine the temporary display device 60 as the driver's attention focus area, and based on this the system may deem the temporary display device 60 as the target display device on which to display a traffic signal status indicator.

FIGS. 3A-C, 4A-C, 5A-C, and 6A-D illustrate different exemplary traffic signal status indicators that may be displayed on the target display device 100 in accordance with aspects of the invention. The target display device 100 may be any of the fixed electronic displays 52*a-f* and the temporary display device 60, as determined based on the determined driver's attention focus area.

In embodiments, the traffic signal status indicators are alerts that are displayed to provide information about the status of the traffic signal (e.g., which light is currently illuminated) and are based on the data received from the traffic signal system 62 about the status of the traffic signal 64. For example, as described herein, the traffic signal system 62 may wirelessly broadcast a status signal that indicates a current light of the traffic signal 64 that is illuminated (e.g., on), a next light of the traffic signal 64 to be illuminated, and how much time remains until the next light of the traffic signal 64 becomes illuminated. Based on the data contained in the status signal, the system may cause the target display device to display information about the status of the traffic signal.

Figure 3A:
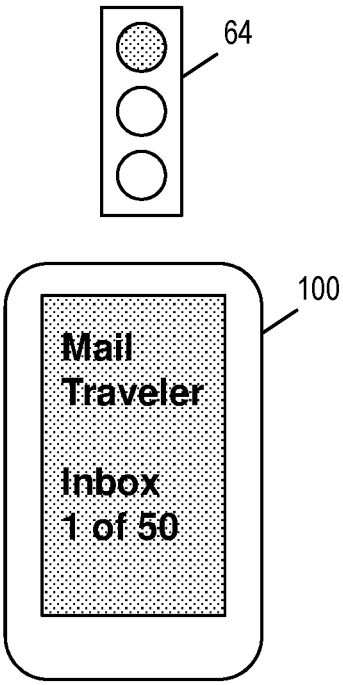
FIGS. 3A-C, 4A-C, 5A-C, and 6A-D show exemplary displays in accordance with aspects of the invention.
Figure 3B:
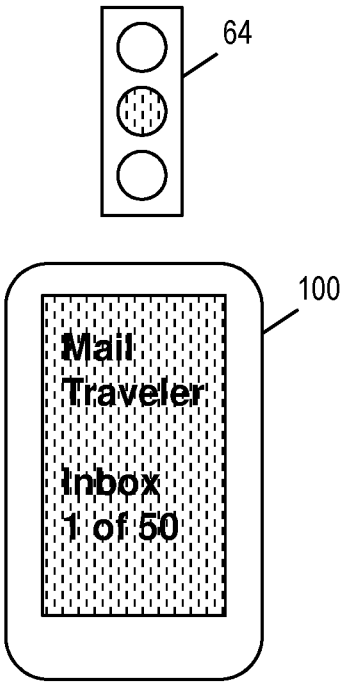
Figure 3C:
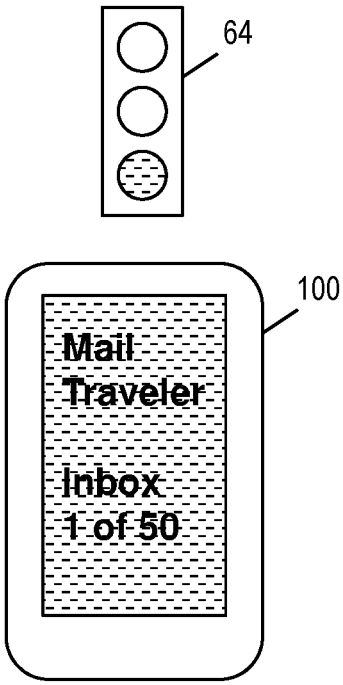

FIGS. 3A, 3B, and 3C show a traffic signal status indicator configuration in which the system causes the target display device 100 to display a background color that corresponds to the color of the light of the traffic signal 64 that is currently illuminated. For example, as shown in FIG. 3A, when the vehicle 50 is stopped at a red light of the traffic signal 64, the system causes the target display device 100 to display a red background that corresponds to the illuminated red light of the traffic signal 64. Similarly, the system causes the target display device 100 to display a yellow background when the yellow light of the traffic signal 64 is illuminated (FIG. 3B), and to display a green background when the when the green light of the traffic signal 64 is illuminated (FIG. 3C). The status signal received from the traffic signal system 62 may be used to determine a change in the status of the traffic signal 64, e.g., a change from a red light to a green light, and the system may cause the target display device to change accordingly. In this manner the system may cause the target display device to change/alter the displayed information based on a changed status of the traffic signal.

Figure 4A:
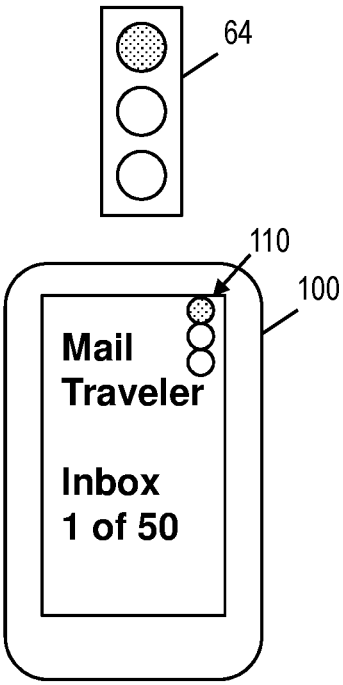
Figure 4B:
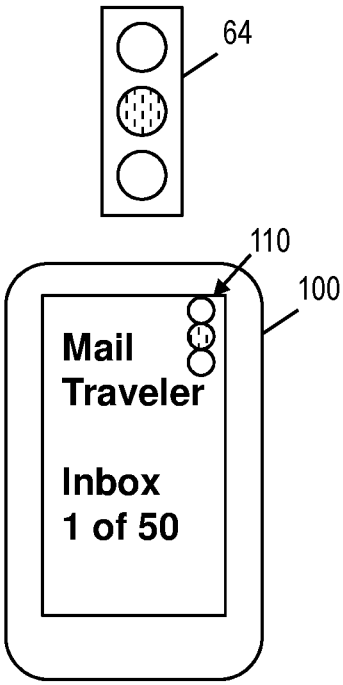
Figure 4C:
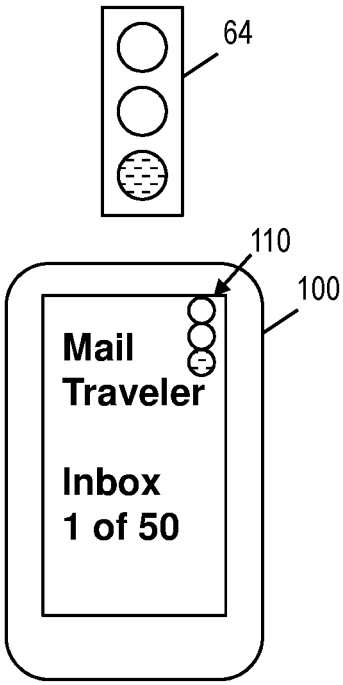

FIGS. 4A, 4B, and 4C show a traffic signal status indicator configuration in which the system causes the target display device 100 to display a traffic signal icon 110 that displays a color that corresponds to the color of the light of the traffic signal 64 that is currently illuminated. For example, as shown in FIG. 4A, when the vehicle 50 is stopped at a red light of the traffic signal 64, the system causes the target display device 100 to display the traffic signal icon 110 with a red color that corresponds to the illuminated red light of the traffic signal 64. Similarly, the system causes the target display device 100 to display the traffic signal icon 110 with a yellow color when the yellow light of the traffic signal 64 is illuminated (FIG. 4B), and to display the traffic signal icon 110 with a green color when the when the green light of the traffic signal 64 is illuminated (FIG. 4C).

Figure 5A:
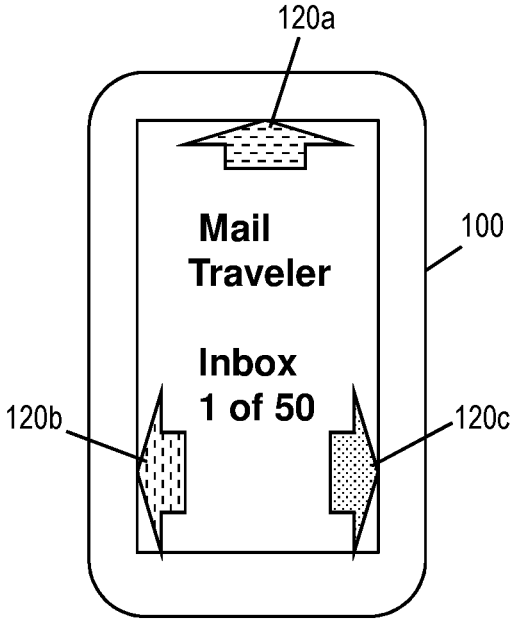
Figure 5B:
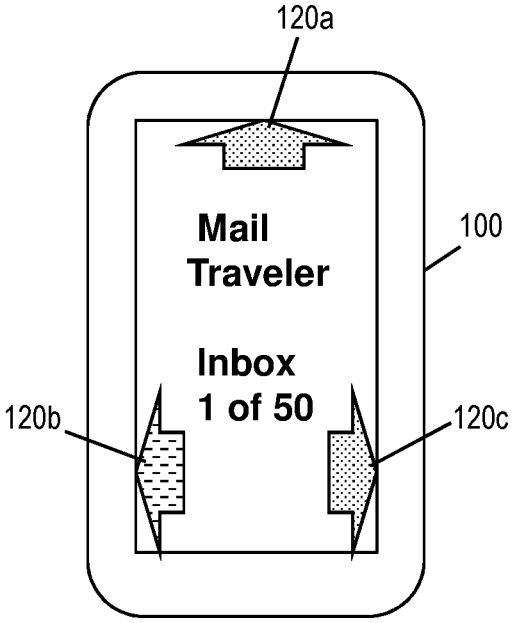
Figure 5C:
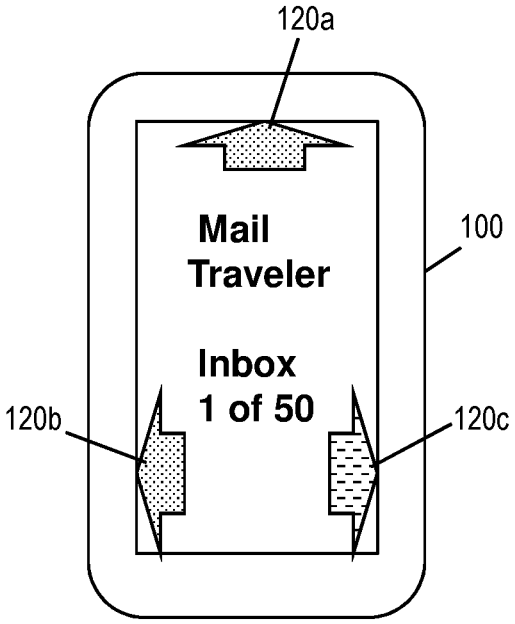

FIGS. 5A, 5B, and 5C show a traffic signal status indicator configuration in which the system causes the target display device 100 to display directional icons 120*a-c* having colors that correspond to colors of lights of the traffic signal 64. For example, as shown in FIG. 5A, a first directional icon 120*a* is green indicating that the driver has a green light for going forward at the intersection, a second directional icon 120*b* is yellow indicating that the driver has a yellow light for turning left at the intersection, and a third directional icon 120*c* is red indicating that the driver has a red light for turning right at the intersection. As shown in FIG. 5B, the first directional icon 120*a* is red indicating that the driver has a red light for going forward at the intersection, the second directional icon 120*b* is green indicating that the driver has a green light for turning left at the intersection, and the third directional icon 120*c* is red indicating that the driver has a red light for turning right at the intersection. As shown in FIG. 5C, the first directional icon 120*a* is red indicating that the driver has a red light for going forward at the intersection, the second directional icon 120*b* is red indicating that the driver has a red light for turning left at the intersection, and the third directional icon 120*c* is green indicating that the driver has a red light for turning right at the intersection. The directional icons 120*a-c* may be changed based on the colors of the lights of the traffic signal 64 at the intersection, e.g., as determined by changes in the status signal from the traffic signal system 62. The directional icons 120*a-c* may be displayed with a map of the intersection and each one of the directional icons aligned with a road of the map.

Figure 6A:
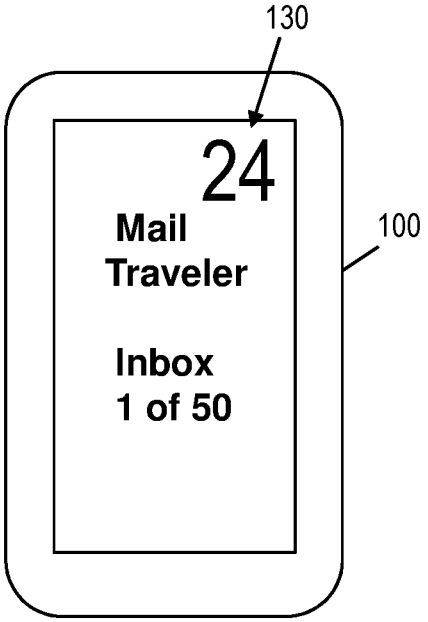
Figure 6B:
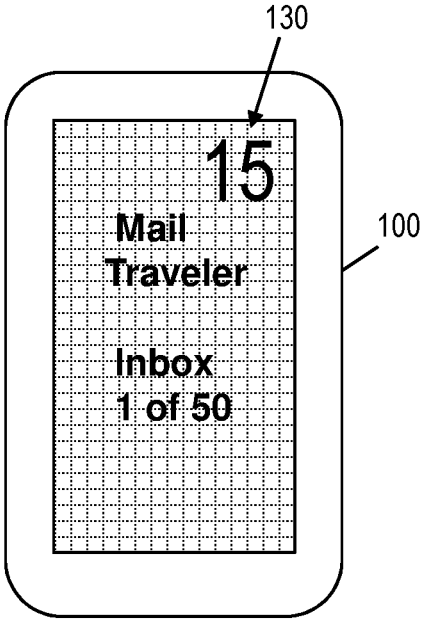
Figure 6C:
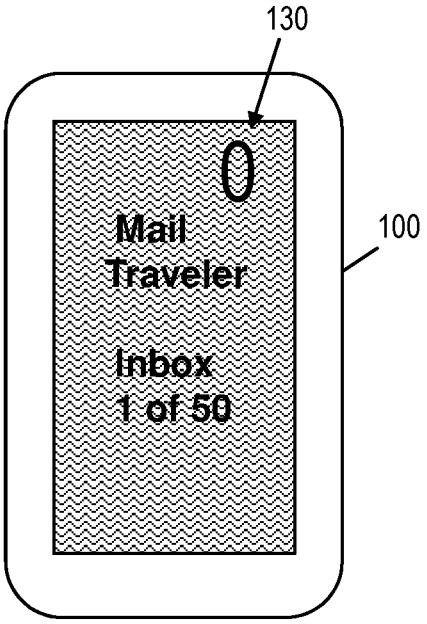
Figure 6D:
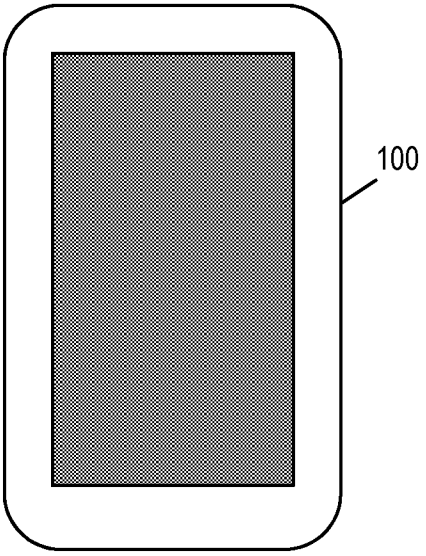

FIGS. 6A, 6B, and 6C show a traffic signal status indicator configuration in which the system causes the target display device 100 to display a counter (e.g., timer) 130 that indicates a time remaining until the traffic signal 64 changes lights (e.g., from red to green). For example, as shown in FIG. 6A, the 130 displays "24" indicating twenty four seconds remain until the traffic signal 64 changes lights (e.g., from red to green). As shown in FIG. 6B, at a later time the 130 displays "15" indicating fifteen seconds remain until the traffic signal 64 changes lights (e.g., from red to green). As shown in FIG. 6C, at a later time the 130 displays "0" indicating that the traffic signal 64 has changed lights (e.g., from red to green). The number displayed by the counter may be derived from data received via the status signal, and may change as subsequent status signals are received.

As also shown in FIGS. 6A-6C, the system may cause the target display device 100 to change background color at certain times remaining on the counter 130. For example, when the time remaining on the counter 130 is greater than the first threshold, the background is a first color. When the time remaining on the counter 130 is less than the first threshold, the background is a second color different than the first color. And when the time remaining on the counter 130 is zero, the background is a third color different from the first color and the second color. The first, second, and third colors can correspond to the color of the light illuminated at the traffic signal, or can be different than the color of the light illuminated at the traffic signal.

Still referring to FIGS. 6A-6C, in embodiments, text on the screen of the target display device 100 is visible even when different background colors are used. In an alternative embodiment shown in FIG. 6D, the system causes the screen of the display device to go blank when the counter reaches zero. In this manner, the user can see the text on the display prior to the traffic signal changing lights (e.g., as at FIGS. 6A and 6B), but cannot see any text on the display when and after the traffic signal changes lights (e.g., as at FIG. 6D).

In an additional embodiment, the system may cause the target display device 100 to emit an audible sound (e.g., tone) and/or vibration that indicates a status of the traffic signal 64. For example, the system may cause the target display device 100 to emit an audible slow ping sound that increases in speed and/or volume as the traffic signal 64 is about to change from red to green, with a final gong sound being emitted to indicate that the traffic signal 64 has changed from red to green.

In an additional embodiment, the system may cause the vehicle 50 to emit an audible message and/or haptic feedback to indicate that the traffic signal 64 has changed from red to green. For example, the system may determine from the direct and indirect indicators that the driver's attention focus area is not directed to an electronic display device. For example, weight sensors and/or cameras (e.g., included in sensors 54) may determine that the driver is twisting their body to reach into the back seat of the vehicle 50. In such a situation, even though the driver is not focusing on an electronic device (e.g., 52*a-f* or 60), the driver's attention is still diverted away from the traffic signal. Accordingly, when the system detects such an action from the driver and the traffic system status signal indicates that the traffic signal has changed from red to green, the system may be configured to cause a vibration of an element of the vehicle 50, e.g., in the steering wheel and/or driver's seat. The vibration may be caused using conventional devices, such as electromechanical actuators, for example.

In embodiments, the system may be programmed to permit the user to configure what type of alert is provided. For example, the user may use a graphic user interface of the computer system 12 and/or temporary display device 60 to select one of: the traffic signal status indicator configuration of FIGS. 3A-C; the traffic signal status indicator configuration of FIGS. 4A-C; the traffic signal status indicator configuration of FIGS. 5A-C; the traffic signal status indicator configuration of FIGS. 6A-D; an audible alert; and a vibrational alert.

Figure 7:
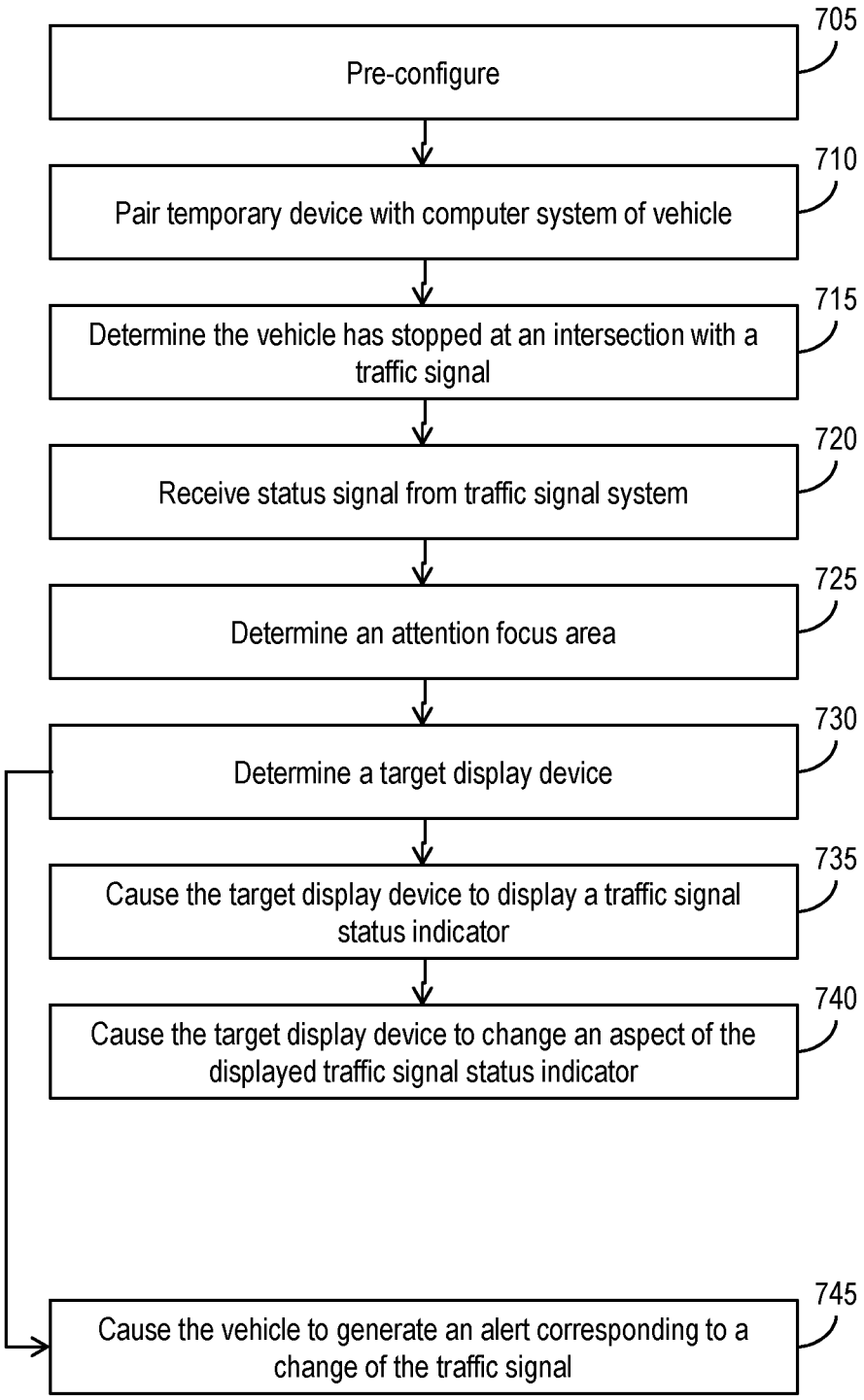
FIG. 7 shows a flowchart of a method in accordance with aspects of the invention.

FIG. 7 shows a flowchart of a method in accordance with aspects of the invention. Steps of the method of FIG. 7 may be performed in the environment illustrated in FIG. 2, and is described with reference to elements shown in FIG. 2.

Step 705 is a pre-configuration step in which the coordinates of fixed display devices (e.g., 52*a-f*) are determined and/or received and stored in the memory of a computer system of a vehicle (e.g., computer system 12 of vehicle 50). Step 705 may also include installing a particular software application program on the computer system of a vehicle and a particular software application program on a temporary display device (e.g., temporary display device 60, such as a smartphone). Step 705 may also include the user configuring the application program on the computer system of a vehicle and/or configuring the application program on a temporary display device, e.g., for a desired type of alerting configuration.

At step 710, the temporary display device is paired with the computer system of the vehicle. Step 710 may be performed in a conventional manner, such as by Bluetooth pairing.

At step 715, the computer system of the vehicle or the temporary display device determines that the vehicle has stopped at an intersection. Step 715 may be performed in a conventional manner, such as using GPS of either system.

At step 720, the computer system of the vehicle or the temporary display device receives a status signal from a traffic signal system that controls a traffic signal at the intersection (e.g., traffic signal system 62 and traffic signal 64). Step 720 may be performed in the manner described with respect to FIG. 2, e.g., by the traffic signal system wirelessly broadcasting the status signal and the computer system of the vehicle or the temporary display device receiving the status signal.

At step 725, the computing device of the vehicle determines the driver's attention focus area. Step 725 may be performed in the manner described with respect to FIG. 2, e.g., by analyzing direct indicators and/or indirect indicators.

At step 730, the system determines a target display device. Step 730 may be performed in the manner described with respect to FIG. 2, e.g., by determining the target display device based on the determined attention focus area.

At step 735, the system causes the target display device to display a traffic signal status indicator. In embodiments, the traffic signal status indicator may be similar to one of the configurations shown in FIGS. 3A-6C.

At step 740, the system causes the target display device to change an aspect of the displayed traffic signal status indicator. In embodiments, the traffic signal status indicator is changed based upon a new status signal of the traffic signal system indicating a change in the traffic signal. In other embodiments, the traffic signal status indicator is changed based upon a passing a time threshold prior to an indicated future change in the traffic signal.

In the event the system cannot determine a target display device at step 730 that coincides with the determined attention focus area, then the process may proceed to step 745 where the system causes the vehicle to generate an alert corresponding to a change of the traffic signal. For example, the system may determine that the driver's focus area in directed toward the rear seat of the vehicle, and the system may cause a vibrational and/or audible alert to occur when the traffic signal changes.

In embodiments, a service provider, such as a Solution Integrator, could offer to perform the processes described herein. In this case, the service provider can create, maintain, deploy, support, etc., the computer infrastructure that performs the process steps of the invention for one or more customers. These customers may be, for example, any business that uses technology. In return, the service provider can receive payment from the customer(s) under a subscription and/or fee agreement and/or the service provider can receive payment from the sale of advertising content to one or more third parties.

In still another embodiment, the invention provides a computer-implemented method for performing one or more of the processes herein on a network. In this case, a computer infrastructure, such as computer system 12 (FIG. 1), can be provided and one or more systems for performing the processes of the invention can be obtained (e.g., created, purchased, used, modified, etc.) and deployed to the computer infrastructure. To this extent, the deployment of a system can comprise one or more of: (1) installing program code on a computing device, such as computer system 12 (as shown in FIG. 1), from a computer-readable medium; (2) adding one or more computing devices to the computer infrastructure; and (3) incorporating and/or modifying one or more existing systems of the computer infrastructure to enable the computer infrastructure to perform the processes of the invention.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer program product for alerting a driver to a status of a traffic signal, the computer program product comprising a computer readable storage medium having program instructions embodied therewith, the program instructions executable by a computing device in a vehicle to cause the computing device to:

detect the vehicle is stopped at an intersection with the traffic signal;

determine an attention focus area of the driver while the vehicle is stopped at the intersection;

determine a target display device based on the determined attention focus area; and cause the determined target display device to display a background color the same as a color of a light illuminated at the traffic signal.

2. The computer program product of claim 1, wherein the determining the attention focus area comprises analyzing at least one of direct indicators and indirect indicators.

3. The computer program product of claim 2, wherein the direct indicators comprise at least one from the group consisting of:

a determined gaze location of the driver;

a determined position of a face of the driver;

a determined location of hands of the driver; and a determined weight of the driver.

4. The computer program product of claim 2, wherein the indirect indicators comprise at least one from the group consisting of:

detecting usage of an input device;

detecting that a screen is turned on;

detecting keystrokes that indicate user action;

detecting messages sent, received or viewed;

detecting applications launched;

detecting user interaction with applications;

detecting a telephone call in progress; and detecting movement of an accelerometer.

5. The computer program product of claim 1, wherein the target display device is a fixed electronic display that is part of the vehicle.

6. The computer program product of claim 1, wherein the target display device is a temporary display device.

7. The computer program product of claim 6, wherein the program instructions cause the computing device to pair with the temporary display device.

8. The computer program product of claim 1, wherein the program instructions cause the computing device to receive a status signal from a traffic signal system associated with the traffic signal.

9. The computer program product of claim 8, wherein the program instructions cause the computing device to compare global positioning system (GPS) coordinates of the vehicle to GPS coordinates included in the status signal.

10. The computer program product of claim 8, wherein:

the computing device causes the determined target display device to display the background color as red based on a red light illuminated being at the traffic signal;

the computing device causes the determined target display device to display the background color as yellow based on a yellow light illuminated being at the traffic signal; and the computing device causes the determined target display device to display the background color as green based on a green light illuminated being at the traffic signal.

11. The computer program product of claim 8, wherein the computing device causes the determined target display device to change the background color from red to green based on the traffic signal changing from a red light to a green light.

12. The computer program product of claim 1, wherein the attention focus area of the driver of the vehicle is determined based on data from at least one sensor.

13. A computer program product for alerting a driver to a status of a traffic signal, the computer program product comprising a computer readable storage medium having program instructions embodied therewith, the program instructions executable by a computing device in a vehicle to cause the computing device to:

detect the vehicle is stopped at an intersection with the traffic signal;

determine an attention focus area of the driver while the vehicle is stopped at the intersection;

determine a target display device based on the determined attention focus area;

receive a status signal from a traffic signal system associated with the traffic signal;

compare coordinates of the vehicle to coordinates included in the status signal; and cause the determined target display device to display a traffic signal icon that displays a color that is the same as a color of a light illuminated at the traffic signal.

14. The computer program product of claim 13, wherein the computing device causes the determined target display device to change the color displayed by the traffic signal icon from red to green based on the traffic signal changing from a red light to a green light.

15. The computer program product of claim 13, wherein the determining the attention focus area comprises analyzing at least one direct indicator from the group consisting of:

a determined gaze location of the driver;

a determined position of a face of the driver;

a determined location of hands of the driver; and a determined weight of the driver.

16. The computer program product of claim 13, wherein the determining the attention focus area comprises analyzing at least one indirect indicator from the group consisting of:

detecting usage of an input device;

detecting that a screen is turned on;

detecting keystrokes that indicate user action;

detecting messages sent, received or viewed;

detecting applications launched;

detecting user interaction with applications;

detecting a telephone call in progress; and detecting movement of an accelerometer.

17. The computer program product of claim 13, wherein the attention focus area of the driver of the vehicle is determined based on data from at least one sensor.

18. A computer program product for alerting a driver to a status of a traffic signal, the computer program product comprising a computer readable storage medium having program instructions embodied therewith, the program instructions executable by a computing device in a vehicle to cause the computing device to:

detect the vehicle is stopped at an intersection with the traffic signal;

determine an attention focus area of the driver while the vehicle is stopped at the intersection;

determine a target display device based on the determined attention focus area;

receive a status signal from a traffic signal system associated with the traffic signal; and cause the determined target display device to display directional icons having colors that correspond to colors of lights of the traffic signal.

19. The computer program product of claim 18, wherein the directional icons are selected from the group consisting of a red arrow, a yellow arrow, and a green arrow.

20. The computer program product of claim 18, wherein the computing device causes the determined target display device to change the displayed directional icons based on changes in the status signal received from the traffic signal system.

* * * * *